United States Patent [19]

Shea

[11] Patent Number: 4,627,128

[45] Date of Patent: Dec. 9, 1986

[54] TOOL FOR CLEANING THE INTERIOR SURFACES OF A CONTAINER

[76] Inventor: Thomas M. Shea, 1865 Harvest La., Bloomfield Hills, Mich. 48013

[21] Appl. No.: 730,846

[22] Filed: May 6, 1985

[51] Int. Cl.[4] ..... A47L 17/06

[52] U.S. Cl. ..... 15/236 R; 15/104 R; 15/245; 294/55

[58] Field of Search ..... 15/236 R, 245, 104 R; D7/102, 104; D32/49; 294/1.1, 55; 73/426

[56] References Cited

U.S. PATENT DOCUMENTS

| | | | |
|---|---|---|---|
| D. 95,949 | 6/1935 | Dunkelberger | D7/104 |
| D. 236,073 | 7/1975 | Monagle | D7/104 |
| D. 278,402 | 4/1985 | Reichard | D7/104 |
| 2,188,114 | 1/1940 | Hubbard | 15/245 |
| 2,807,168 | 9/1957 | Wipf | 73/427 |
| 2,935,758 | 5/1960 | Muscott | 15/236 |
| 3,504,391 | 4/1970 | McCarty | 15/236 |
| 3,551,937 | 1/1971 | Nelson | 15/236 |
| 4,324,018 | 4/1982 | Olsson | 15/236 |
| 4,355,432 | 10/1982 | Storm, Jr. | 15/245 |
| 4,380,840 | 4/1983 | Rieckenberg | 15/105 |

*Primary Examiner*—Edward L. Roberts

*Attorney, Agent, or Firm*—Gifford, Groh, VanOphem, Sheridan, Sprinkle & Dolgorukov

[57] ABSTRACT

A hand tool for cleaning and scraping the interior surfaces of a cylindrical container containing paint or other chemical solvents and solutions includes a handle and a blade member which complements and conforms to the interior surfaces of the container. The blade member has a substantially semicylindrical shape to facilitate removal of residual materials from the container and a bottom surface which is angled to provide access to the bottom surface of the container. In addition, the bottom surface of the blade has an outer edge which conforms to the shape of the sidewalls of the container to increase the residue removing capabilities of the tool. The working edges of the blade are beveled to further facilitate removal of residual material.

8 Claims, 4 Drawing Figures

TOOL FOR CLEANING THE INTERIOR SURFACES OF A CONTAINER

BACKGROUND OF THE INVENTION

I. Field of the Invention

This invention relates to a tool for cleaning cylindrical containers and, in particular, to a tool for cleaning and salvaging residual amounts of material from the interior walls of a can.

II. Description of the Prior Art

Past known devices have provided various solutions for salvaging residual amounts of material or solvents from the interior of a cylindrical container. These devices generally comprise a blade member which conforms to either the side walls or the bottom of the can. In addition, a handle is provided to allow the blade member to be extended into the interior of the container.

Typical of the prior known devices utilized to clean the interior walls of a can is a tool which utilizes a curved blade member integrally secured to a short handle. The blade has a substantially concave curvature with a rounded bottom edge. The curvature of the blade, and particularly the bottom edge, conforms to the curvature of the can wall thereby facilitating scraping of the interior wall. However, the device is designed to scrape or "push" the residual material to the bottom of the can where a majority of the material is collected and removed. No means are provided for cleaning the bottom of the can or for removing the residual material directly from the side wall of the can. Thus, a substantial amount of material is left in the can although the known device facilitates removal of a majority of the residual material from the side wall of the can.

Similarly, known devices can be utilized to remove residual material from the bottom of the can. Generally, these devices are provided with a substantially planar blade member which is disposed perpendicular to and integral with one end of an elongated handle. The handle is flexible in order to allow the blade member to conform with the bottom surface of the container to scrape the material thereon toward the side wall of the can. The outer periphery of the blade is curved complementally to the curved side wall of the can to facilitate removal of material along the side wall as the tool is drawn along the wall. Again, however, no means are provided for removing the residual material from the can once the interior walls are scraped. Any accumulated material must be poured out of the can once it is drawn towards the can opening.

SUMMARY OF THE PRESENT INVENTION

The present invention overcomes the disadvantages of the prior art by providing a tool which is capable of scraping the interior walls of a cylindrical container and removing the residual material from the interior of the container in one sweeping motion.

The tool according to the present invention generally comprises a blade member integrally formed with an elongated handle. The blade member has a substantially semi-cylindrical shape which readily conforms to the side walls of a cylindrical container. The bottom end of the blade forms an obtuse angle to the axis of the blade and handle and has a substantially elliptical shape. The edges of both the end member and the semi-cylindrical blade member are beveled to improve scraping and salvaging of residual material.

The shape and construction of the present invention thus facilitates removal of residual material with one sweeping motion around the interior of the can. As the blade travels around the interior walls, any residual material from the side wall accumulates within the concave blade. Similarly, the end member scrapes the bottom of the container during the same motion. Any remaining material, particularly the material not scraped from the corner formed by the side and bottom walls, can be removed by the curved peripheral edge of the end member.

Other objects, features, and advantages of the present invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
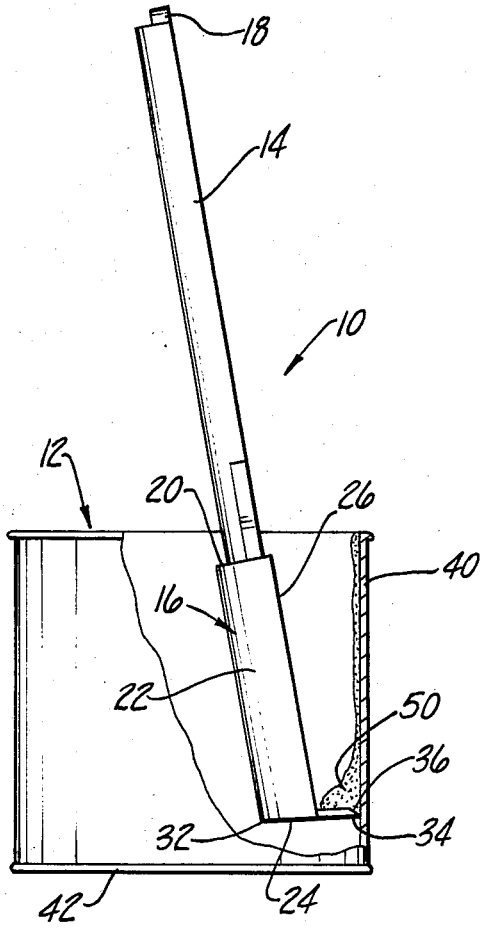
FIG. 1 is a side view of the tool of the present invention in use within a cylindrical container with a portion of the wall of the container cut-away for clarity.

Referring generally to FIGS. 1 through 4, there is shown a tool 10 embodying the present invention, for cleaning the interior surfaces of a cylindrical container 12 and comprising generally an elongated handle 14 and a blade 16. Preferably, the handle 14 and the blade 16 are integrally molded from a polypropylene material which is resistant to dissolution and corrosion from chemical solvents and solutions which may be stored in cylindrical containers.

Figure 2:
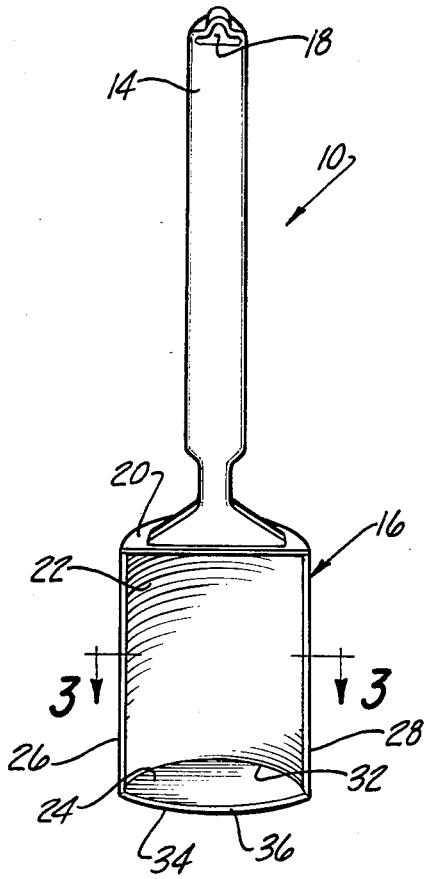
FIG. 2 is an elevated perspective of the tool of the present invention.

As is shown in FIGS. 1 and 2, the handle 14 is preferably of sufficient length to permit a user to reach within containers 12 of varying depths while reducing the risk of contact with the interior of the container 12 and its contents. In addition, the handle 14 has a circumference which facilitates a secure grip of the tool 10 during use. An opening or notch 18 is provided at the end of the handle 14 to permit storage of the tool 10 or, alternatively, to facilitate carrying the tool 10 on an accessory belt or similar device (not shown).

Figure 3:
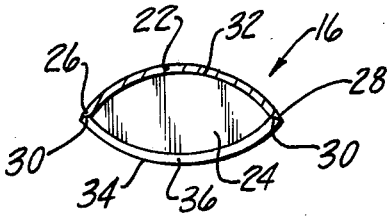
FIG. 3 is an cross-sectional perspective of the present invention taken along lines 3—3 of FIG. 2.

Referring now to FIGS. 2 and 3, the blade 16 has a substantially semi-cylindrical shape and comprises a first end wall 20, an intermediate portion 22, and a second end wall 24, all of which are integrally molded to form the working portion of the blade 16. The blade 16 is substantially coaxial with and secured to one end of the handle 14.

The first end wall 20 is secured perpendicular to the axis of the handle 14 and has a substantially semi-circular shape which conforms to the semi-cylindrical shape of the blade 16.

An intermediate portion 22 is formed by a wall having a concave curvature which gives the blade 16 its semi-cylindrical shape. The curvature of the intermediate portion 22 conforms to the curvature of the first end wall 20 and is preferably integrally formed therewith. Intermediate portion 22 also has a pair of edges 26 and 28 which are parallel to each other and to the axis of the handle 14. The edges 26 and 28 are provided with an inwardly angled removed portion (FIG. 3) which forms a bevel 30 to facilitate the cleaning and salvaging operation as will be hereinafter described.

Finally, the second end wall 24 is formed at one end of the intermediate portion 22 opposite from the first end wall 20 and remote from the handle 14. The second end wall 24 is planar and has a substantially elliptical shape formed by inner edge 32 and outer peripheral edge 34. The inner edge 32 of second wall 24 conforms to the shape of the intermediate portion 22. Similarly, peripheral edge 34 of the end wall 24 has a curvature which is complementary to the curvature of the side wall 40 of container 12 in order to facilitate scraping of the side wall 40 as will be described hereinafter. As with edges 26 and 28 of intermediate portion 22, the outer peripheral edge 34 of the second end wall 24 is provided with a bevel 36 which improves the salvaging capabilities of the tool 10. Moreover, the second end wall 24 is found at an obtuse angle to the axis of the handle 14 which facilitates bottom scraping of the cannister and which allows the user to view the scraping operation as will be hereinafter described. Finally, the second end wall 24 is formed of flexible material to yield as the second end wall 24 engages the bottom 42 of the cannister.

Figure 4:
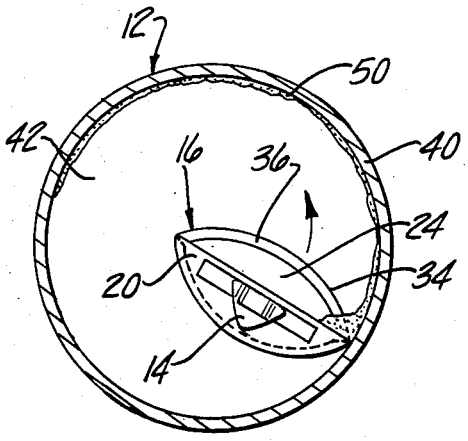
FIG. 4 is a top view of the present invention in use within a cylindrical container as viewed through the top opening of the container.

Referring now to FIGS. 1 and 4, operation of the tool 10 substantially simplifies the cleaning of the inner walls of the container 12 while increasing salvage of residual amounts of material 50 from cylindrical containers. Cylindrical containers or cans are generally utilized to store materials of varying viscosities. Chemical solvents typically have a lower viscosity which causes the material to accumulate near the bottom of the container. In contrast, higher viscosity materials, such as paint, tend to adhere to the side walls of the container. The tool 10 of the present invention facilitates salvage and removal of residual material 50 from both the bottom 42 and the side wall 40 of the container 12.

As is shown in FIG. 4, the side wall 40 of the container 12 is first cleaned by rotating the tool 10 about the axis of the container 12 with either edge 26 or 28 in contact with the side wall 40. The outer portion of the edge 26 or 28 is not beveled and therefore provides flush contact with the side wall 40. Conversely, the bevel 30 of the edges 26 and 28 improves the salvage by directing any residual material 50 into the semi-cylindrical blade 16. When the blade or scoop 22 becomes full, the salvaged material 50 can be easily removed by lifting the tool 10 out of the container 12.

As shown in FIG. 1, the peripheral edge 34 of the second end wall 24 allows the user to remove any residual material 50 from the bottom 42 of the container 12 or the corner formed by side wall 40 and bottom 42. The second end wall 24 of the tool 10 provides flush contact with the bottom 42 of the container 12 thereby directing residual material 50 towards the side wall 40 as the tool is moved along the bottom 42. In addition, the bevel 36 of peripheral edge 34 directs material into the scoop portion of the tool 10 which can thereafter be lifted out of the container 12.

The obtuse angle of the second end 24 with respect to the axis of the handle 14 facilitates maintaining the flush contact between the the tool 10 and the bottom 42 of the container 12.

Moreover, the curvature of the peripheral edge 34 conforms to the curvature of the side wall 40 of the container 12 which allows the user to scrape or pull any remaining material along the side wall 40 and out of the container 12. Thus, removal of any remaining material 50 can be accomplished by moving the second end wall 24 of the tool 10 along the bottom 42 of the container and thereafter pulling the peripheral edge 34 along the side wall 40. This operation can be repeated until all residual material 50 is cleaned from the bottom 42, the corner formed by the sidewall 40 and the bottom 42, and the side wall 40 of the cylindrical container 12. Throughout this final scraping operation, the obtuse angle of the second end wall 24 with respect to the axis of the handle 14 allows the user to view the operation while sustaining optimum contact between the peripheral edge 34 and the side wall 40.

Having thus described my invention, however, many modifications thereto will become apparent to those skilled in the art to which it pertains without deviation from the spirit of the invention as defined by the scope of the appended claims.

I claim:

1. A tool for scraping and cleaning an interior surface of a cylindrical container, said tool comprising:

an elongated handle having a longitudinal axis; and a blade member integrally secured to one end of said handle wherein said blade member comprises:

a substantially semicircular first end wall, said first end wall disposed perpendicular to said longitudinal axis of said handle, said first end wall having a semicircular edge;

an intermediate main portion having a substantially semicylindrical concave curvature formed about said axis of said handle wherein said main portion extends from and has a curvature coinciding with the semicircular edge of said first end member; and a substantially elliptical second end wall secured to the opposite end of said main portion from said first end wall wherein said second end wall forms an obtuse angle with respect to said axis of said handle, said second end wall being flexible whereby said second end wall yields as second second end wall engages a bottom surface of said cylindircal container.

2. The tool as defined in claim 1 wherein said second end wall has an outer peripheral edge having a curvature complementary to the curvature of said interior surface of said cylindrical container.

3. The tool as defined in claim 2 wherein said peripheral edge of said second end wall is beveled.

4. The tool as defined in claim 3 wherein said bevel is formed on an inner surface of said second end wall and wherein the outer surface of said second end wall is flat for engaging a bottom surface of said cylindrical container.

5. The tool as defined in claim 1 wherein said main portion of said blade member further comprises a pair of edges, said pair of edges disposed parallel to said axis of said handle.

6. The tool as defined in claim 5 wherein said pair of edges of said main portion are beveled along an inner surface of said pair of edges.

7. The tool as defined in claim 1 wherein said blade member has a length substantially equal to the height of the sidewalls of said cylindrical container.

8. The tool as defined in claim 1 wherein said tool is made from a polypropylene material resistive to dissolution in chemical solvents and solutions.

* * * * *